United States Patent [19]

Konno

[11] 4,008,697

[45] Feb. 22, 1977

[54] INTERNAL COMBUSTION ENGINE

[75] Inventor: Mitsutaka Konno, Yokohama, Japan

[73] Assignee: Nissan Motor Co., Ltd., Yokohama, Japan

[22] Filed: May 13, 1975

[21] Appl. No.: 577,025

[30] Foreign Application Priority Data

July 19, 1974 Japan ..... 49-85910[U]

[52] U.S. Cl. ..... 123/117 A; 74/860; 123/119 A

[51] Int. Cl.[2] ..... F02P 5/04; F02M 25/06

[58] Field of Search ..... 123/119 A, 117 A; 74/860, 856

[56] References Cited

UNITED STATES PATENTS

| | | | |
|---|---|---|---|
| 3,486,595 | 12/1969 | Turner | 123/117 A X |
| 3,584,521 | 6/1971 | Tooker et al. | 123/117 A X |
| 3,753,377 | 8/1973 | General | 123/117 A X |
| 3,783,847 | 1/1974 | Kolody | 123/119 A |
| 3,800,764 | 4/1974 | Goto et al. | 123/119 A |

*Primary Examiner*—Charles J. Myhre
*Assistant Examiner*—Tony M. Argenbright

[57] ABSTRACT

An engine emission control system includes exhaust gas recirculation and engine spark timing control devices each connected to axially spaced exhaust gas recirculation and spark ports in the carburetor induction passage above the closed position of the throttle valve. Under the control of a single electro-magnetically operated valve, the exhaust gas recirculation and engine spark timing control devices are selectively disabled. The valve selectively bleeds a vacuum conduit connecting the exhaust gas recirculation device to the exhaust gas recirculation port or a vacuum conduit connecting the engine spark timing control device to the spark port.

2 Claims, 2 Drawing Figures

INTERNAL COMBUSTION ENGINE

Figure 1:
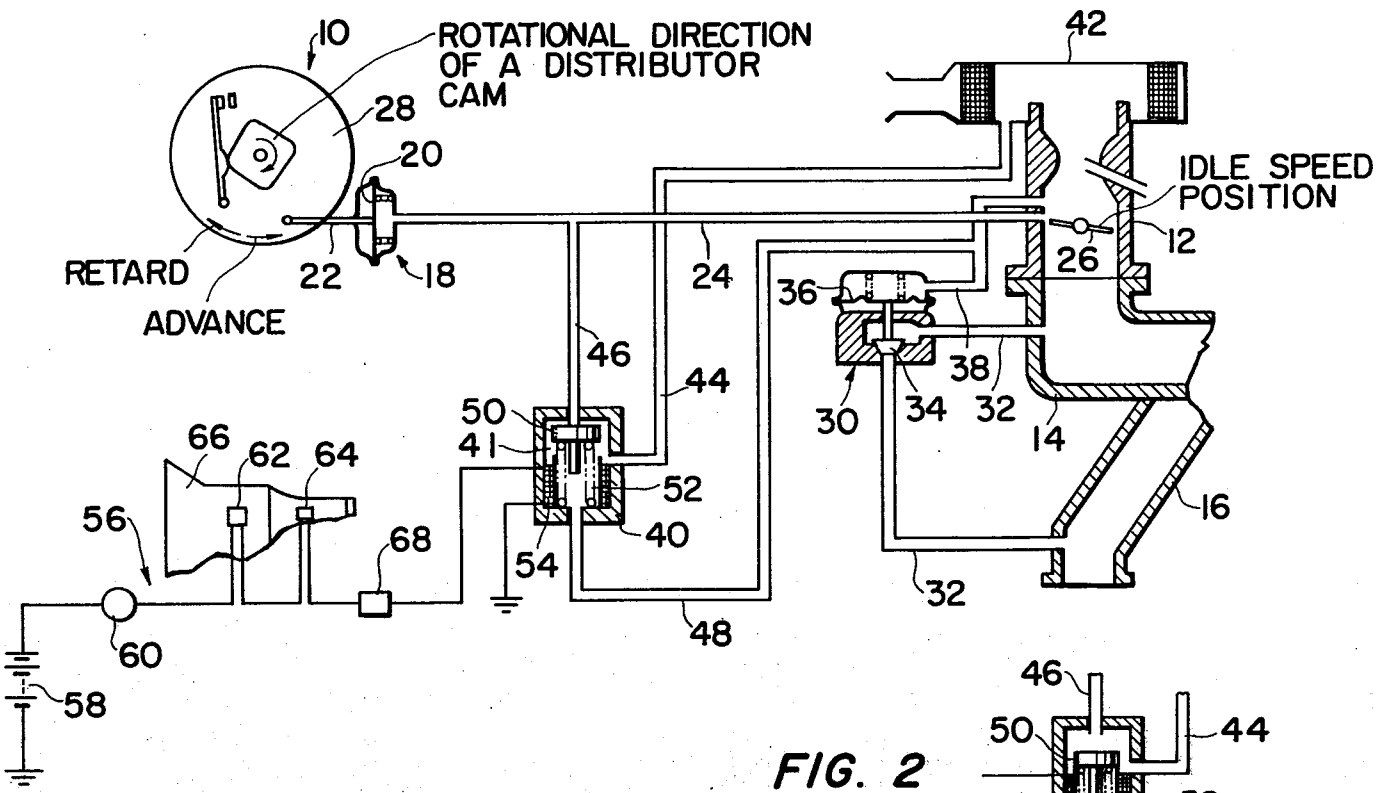

The present invention relates to an internal combustion engine with exhaust gas recirculation and engine spark control devices. More particularly it relates to an internal combustion engine for automobiles, in which retardation of spark timing and exhaust gas recirculation are effected when they are required under the control of one electro-magnetically operated valve means. The electro-magnetically operated valve means is operatively connected with a control circuit which includes means responsive to a predetermined gear position or speed range of a transmission following the engine.

Retarding engine spark timing results in reductions in carbon monoxide (CO) and hydrocarbons (HC) emissions and exhaust gas recirculation (EGR) results in a reduction in nitrogen oxides ($NO_x$) emission. However, retardation of the spark timing and recirculation of exhaust gas are not necessary in any of the following operating conditions: idling, overrunning, full load, or when the engine is running at a temperature below a predetermined level.

One of the conventional engine spark timing systems intended for achieving the above-mentioned requirements is constructed of: a vacuum conduit connecting a vacuum actuated advance unit with a spark port in a carburetor induction passage above the idle speed position of a throttle valve; an electro-magnetically operated air bleed valve fluidly disposed intermediate between the vacuum conduit and an engine air cleaner; and a control circuit for energization of a solenoid of the air bleed valve including a transmission shift condition detecting switch which is closed or closes its associated contacts when the transmission is shifted to a predetermined speed range, namely, low and intermediate speed range, and is operated as follows: when the transmission is in the low and intermediate speed range and then the transmission switch is closed, the electro-magnetically operated air bleed valve is opened due to energization of its solenoid by the control circuit to permit atmospheric air into the vacuum conduit, thus permitting the vacuum actuated advance unit to move the distributor breaker plate to the ignition retard position; when the transmission is shifted to a high speed range and then the transmission switch is opened, the air bleed valve is closed due to the deenergization of the solenoid to prevent the entry of air into the vacuum conduit, thus actuating the vacuum actuated advance unit by vacuum at the spark port, with the result that the spark timing is advanced. With this conventional spark timing control system, purification of exhaust gas during low and intermediate speed range of the transmission is achieved by retarding spark timing and, the maximum power output during high speed range of the transmission is produced by permitting the vacuum actuated advance unit to be actuated by vacuum at the spark port, i.e. by advancing the spark timing.

One of the conventional exhaust gas recirculation (EGR) systems is constructed of: a recirculation conduit; a vacuum operated exhaust gas flow control valve to control exhaust gas flow in the recirculation conduit; a vacuum conduit connecting the control valve with and EGR port in the carburetor induction passage and above the idle speed position of the throttle valve to open the flow control valve by vacuum at the EGR port; and an electro-magnetically operated air bleed valve fluidly disposed intermediate between the vacuum conduit and engine air cleaner; and a control circuit having a transmission shift condition detecting switch which is closed or closes its associated contacts when the transmission is shifted to a predetermined speed range, namely, low and intermediate speed range, and is operated as follows: when the transmission is in the low and intermediate speed range and then the transmission switch is closed, the electro-magnetically operated air bleed valve is closed due to energization of its solenoid by the control circuit to prevent the entry of atmospheric air into the vacuum conduit, thus opening the flow control valve by vacuum at the vacuum port, with the result that the exhaust gas recirculation is effected when the transmission is shifted to a high speed range and the transmission switch is opened, the air bleed valve is opened due to deenergization of the solenoid to permit the atmospheric air into the vacuum conduit, thus deactuating the flow control valve, with the result that the recirculation of exhaust gas is prevented. With this conventional exhaust gas recirculation system, purification of exhaust gas during low and intermediate speed range of the transmission is achieved by the recirculation of exhaust gas and the maximum power output during high speed range of the transmission is produced by preventing the exhaust gas recirculation.

It is possible, as a proposal, to provide an internal combustion engine with both of the above-mentioned conventional spark timing system and exhaust gas recirculation system in order that when the transmission is in low and intermediate speed range (this range frequently used), retardation of spark timing and recirculation of exhaust gas are effected to purify the engine exhaust gas and, when the transmission is in high speed range (this range not frequently used, but high power output required), they are not effected to achieve fuel economy and high power output of the engine. This proposal leads, however, to complexity upon arrangement of necessary component parts for the whole system and cost increase because two electro-magnetically operated air bleed valves and their external connections have to be appropriately arranged in limited space available.

It is an object of the present invention to provide an engine spark timing and exhaust gas recirculation control which is simple in arrangement and less costly.

Figure 2:
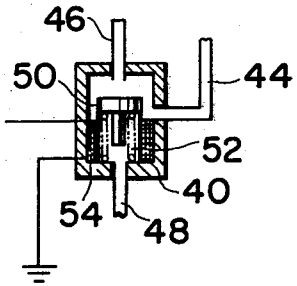

Other objects and features of the present invention will be understood from the following description with reference to the accompanying drawing, in which:

FIG. 1 is a diagram showing a preferred embodiment of a system, including an electro-magnetically operated air bleed valve, for controlling spark timing and exhaust gas recirculation in an internal combustion engine in accordance with the present invention; and FIG. 2 is a partial view of the system of the present invention.

Referring to the drawings and more particularly to FIG. 1, there is shown a distributor breaker 10 of a spark timing control for an internal combustion engine, only a carburetor 12, an intake manifold 14 and an exhaust manifold 16 of which are diagrammatically shown. To obtain spark advance, a vacuum actuated advance unit 18 is operatively connected to the distributor breaker 10, and it has a spring-loaded diaphragm 20, and a diaphragm connecting link 22. A vacuum conduit 24 connects the spring-loaded side of the diaphragm 20 with a spark port in a carburetor induction passage above the idle speed position of a throttle valve 26 to apply vacuum to the spring-loaded side of the diaphragm 20. A movable breaker plate 28 of the distributor breaker 10 is rotated counterclockwise (as viewed in FIG. 1) by the diaphragm 20 and link 22 to advance the spark timing as the vacuum increases.

To recirculate a portion of exhaust gas from the exhaust manifold 16 into the intake manifold 14, an exhaust gas recirculation device 30 is provided. The device 30 includes an exhaust gas recirculation conduit 32 leading from the exhaust manifold 16 to the intake manifold 14 to recirculate a portion of exhaust gases into the intake manifold 14 and a vacuum operated flow control valve 34 operated by a spring-loaded diaphragm 36. A vacuum conduit 38 connects the spring-loaded side of the diaphragm 36 with an EGR port in the carburetor located at a position above the throttle valve 26, preferable above and axially spaced from the spark port. The flow control valve 34 closes the recirculation conduit 32 when the vacuum in the vacuum conduit 38 decreases to the atmospheric pressure and, the opening degree of the valve 34 increases as the manifold vacuum increases.

An electro-magnetically operated valve unit 40 is fluidly disposed intermediate the discharge side of an engine air cleaner 42, vacuum conduit 24 and vacuum conduit 38 to selectively apply the atmospheric pressure to the vacuum actuated advance unit 18 and to the vacuum operated flow control valve 34. The electro-magnetically operated valve unit 40 has an atmospheric chamber 41 to which three conduits 44, 46 and 48 open. Conduit 44 is connected with the air cleaner 42, conduit 46 with the vacuum conduit 24 and conduit 48 with the vacuum conduit 38. A valve member 50 within the atmospheric chamber 41 is yieldably urged by a spring 52 to close the conduit 46 when a solenoid 54 is not energized, so that conduits 44 and 48 are fluidly connected with each other to permit atmospheric air into the vacuum conduit 38 thereby to apply atmospheric pressure to the spring loaded side of the diaphragm 36 (see the position of parts in FIG. 1). Energization of the solenoid 54 causes the valve member 50 to be urged against the spring 52 to the position of FIG. 2. In the position of FIG. 2 conduits 44 and 46 are fluidly connected with each other and the conduit 48 is closed to apply atmospheric pressure to the spring loaded side of the diaphragm 18.

Energization of the solenoid 54 of the electro-magnetically operated valve unit 40 is by a control electric circuit 56 including a battery 58 and a master key switch 60, that is, an ignition switch. Also circuited are a transmission switch 62 and a neutral switch 64 which is connected in series with the transmission switch 62. The transmission switch 62 closes its associated contacts (not shown) when transmission 66 is shifted to a low and intermediate speed range and the neutral switch 64 opens its associated contacts (not shown) when the transmission is in the neutral position. Preferably an engine temperature switch 68, which closes its associated contacts when the engine temperature is above a predetermined level, is circuited in series with the switches 62 and 64.

It will now be understood when the electromagnetic valve 40 is energized (see the positions of FIG. 2) responsive to the closure conditions of all the switches 60, 62, 64 and 68 of the control circuit 56, the vacuum in the vacuum conduit 24 is reduced to zero, and the vacuum is produced in the vacuum conduit 38, with the result that the retardation of spark timing and the exhaust gas recirculation are effected. When any one of the switches 60, 62, 64 and 68 is opened, the valve 40 is deenergized (see FIG. 1) to apply vacuum to the vacuum conduit 24 and to allow the atmospheric air into the vacuum conduit 38 to reduce vacuum therein to zero. Therefore, spark timing is advanced and the exhaust gas recirculation is prevented.

It will now be understood that when the transmission 66 is in the low and intermediate speed range, the retardation of spark timing and the exhaust gas recirculation are effected for purification of the exhaust and, when the transmission 66 is in high speed range spark timing is advanced and the exhaust gas recirculation is prevented for fuel economy and power output increase.

It will be appreciated that according to the present invention the difficulty of arranging the component parts necessary for the whole system is reduced and, cost increase is also suppressed because two electro-magnetically operated air bleed valves which were necessary are replaced by one electro-magnetically operated air bleed valve 40.

It is to be noted that the control circuit 56 is not limited to the example shown. The control circuit 56 may include in series with the transmission switch 62, a throttle position switch which is closed responsive to a predetermined throttle position and/or a thermoswitch which is closed responsive to a predetermined engine coolant temperature in order to determine operation conditions of the engine where the retardation of spark timing and the recirculation of exhaust gas are required.

What is claimed is:

1. An engine spark timing and exhaust gas recirculation control comprising, in combination:

a carburetor induction passage having a throttle valve rotatably mounted therein and adapted to be connected to an intake manifold of the engine, a spark port in the induction passage located above an idle speed position of said throttle valve and an exhaust gas recirculation port located in the induction passage above and axially spaced from said spark port;

a vacuum actuated engine spark timing advance unit for advancing the engine spark timing in response to the vacuum applied thereto;

a vacuum actuated exhaust gas recirculation control valve adapted for controlling the flow of the exhaust gas back from an exhaust manifold of the engine to said intake manifold in response to the vacuum applied thereto;

a first conduit means connecting said spark port to said vacuum actuated engine timing advance unit;

a second conduit means connecting the exhaust gas recirculation port to the vacuum actuated exhaust gas recirculation control valve;

an electro-magnetically operated valve means having a chamber which is open to the atmosphere through an engine cleaner, a first port opening to the chamber, a second port opening to the chamber, a valve member movable between the first and second ports, a spring means biasing said valve member toward the first port to close the same, and a solenoid means uring the valve member toward the second port, when energized, to close the same;

a first branch conduit means connecting the first conduit means to the first port;

a second branch conduit means connecting the second conduit means to the second port; and means for energizing the solenoid means during a predetermined engine operating condition.

2. An engine spark timing and exhaust gas recirculation control as claimed in claim 1, in which the energizing means comprises an engine ignition switch connected to a terminal of a source of electrical energy, a transmission switch connected in series with the ignition switch, a neutral switch connected in series with the transmission switch and an engine temperature switch connected in series with the neutral switch, said engine temperature switch being connected to one side of said solenoid means and the other side of said solenoid means being connected to an opposite terminal of the energy source, said transmission switch closing its associated contacts when the associated transmission of the engine is in low and intermediate speed range, said neutral switch opening its associated contacts when the transmission is in the neutral position, and said engine temperature switch closing its associated contacts when the engine temperature is above a predetermined level.

* * * * *